US006221161B1

(12) United States Patent
Killingbeck et al.

(10) Patent No.: US 6,221,161 B1
(45) Date of Patent: Apr. 24, 2001

(54) APPARATUS FOR COATING FIBERS

(75) Inventors: Bruce Killingbeck, Leroy; Charles A. Priese, Reed City, both of MI (US)

(73) Assignee: Pilot Industries, Inc., Dexter, MI (US)

( * ) Notice: Subject to any disclaimer, the term of this patent is extended or adjusted under 35 U.S.C. 154(b) by 0 days.

(21) Appl. No.: 09/298,011

(22) Filed: Apr. 22, 1999

(51) Int. Cl.[7] ..... B05C 3/12

(52) U.S. Cl. ..... 118/420; 118/427; 118/428; 118/429

(58) Field of Search ..... 118/400, 420, 118/427, 428, 429, DIG. 19; 425/93

(56) References Cited

U.S. PATENT DOCUMENTS

| | | | | |
|---|---|---|---|---|
| 1,203,294 | * | 10/1916 | Will | 118/420 |
| 1,321,977 | * | 11/1919 | Burg | 118/420 |
| 1,759,326 | * | 5/1930 | Scholler | 118/DIG. 19 X |
| 1,997,926 | * | 4/1935 | Franks | 118/DIG. 19 X |
| 2,052,980 | * | 9/1936 | Kriebel | 118/123 |
| 2,440,179 | * | 4/1948 | Mabli | 118/420 |
| 2,445,372 | * | 7/1948 | Trenbath | 280/11.28 |
| 2,527,465 | * | 10/1950 | Toulmin, Jr. | 118/420 X |
| 2,699,592 | * | 1/1955 | Newnam | 118/DIG. 19 X |
| 3,126,608 | * | 3/1964 | Whitehurst | 118/DIG. 18 X |
| 3,203,826 | * | 8/1965 | Stobierski | 427/357 |
| 3,598,639 | * | 8/1971 | Hansson et al. | 118/420 X |
| 4,081,005 | * | 3/1978 | Gray et al. | 118/428 X |
| 4,207,362 | * | 6/1980 | Porter et al. | 118/420 X |

* cited by examiner

*Primary Examiner*—Mark A. Osele
(74) *Attorney, Agent, or Firm*—Gifford, Krass, Groh, Sprinkle, Anderson & Citkowski, P.C.

(57) ABSTRACT

An apparatus is disclosed for coating fibers with a thermoplastic material. The apparatus includes a housing which defines a reservoir and having an open top open to the reservoir. A lid is selectively movable between an open and a closed position so that, in its open position, the lid exposes the reservoir and in its closed position, the lid overlies the open top of the housing and forms a slot between the lid and the housing at opposed ends of the housing. An elongated wiper is secured to the lid and this wiper extends into the reservoir when the lid is in its closed position. At least one infeed guide bar is secured to the housing between the wiper and one of the opposed ends of the housing and, similarly, at least one outfeed guide bar is secured to the housing between the wiper and the other of the opposed ends of the housing. Thus, with fibers extending between the slots at the opposed ends of the housing and the lid moved to its closed position, the wiper immerses a portion of the fibers into the reservoir which is filled with molten thermoplastic material. As the fibers are drawn through the housing, the wiper ensures that the fibers are immersed in the thermoplastic material thus coating the fibers.

10 Claims, 2 Drawing Sheets

APPARATUS FOR COATING FIBERS

BACKGROUND OF THE INVENTION

I. Field of the Invention

The present invention relates to an apparatus for coating fibers with a thermoplastic material.

II. Description of the Prior Art

In order to increase the strength and durability of molded plastic parts, it has been previously known to introduce fibers into the plastic parts. These fibers may be of any conventional material, such as fiberglass.

Such fibers, however, increase the strength of the molded part only when the fibers are coated with a thermoplastic material. Conversely, unless the individual fibers are completely coated with the thermoplastic material, the fibers remain flexible and not only fail to strengthen the final molded part, but may actually introduce points of weakness in the final molded part.

There have been previously known devices for coating elongated fibers with a thermoplastic material and, after coating the fibers, chopping the coated fibers into relatively short lengths. The chopped coated fibers are then used as the raw material for a subsequent molding operation.

These previously known devices, however, have not proven entirely satisfactory in use. One disadvantage of these previously known devices is that it was difficult and time consuming to load the fibers into the apparatus, which adversely affected production of the coated fibers. Similarly, these previously known devices have been able to coat only a limited number of fibers thus adversely affecting the production efficiency of the coated fibers.

SUMMARY OF THE PRESENT INVENTION

The present invention provides an apparatus for coating fibers with a thermoplastic material which overcomes all of the above-mentioned disadvantages of the previously known devices.

In brief, the device of the present invention comprises a housing defining a reservoir in which thermoplastic material is introduced. Heaters are contained within the housing in order to maintain the thermoplastic material in a molten state in the reservoir. The housing also includes an open top which is open to the reservoir.

A lid is selectively movable between an open and a closed position. In its open position, the lid is moved away from the open top of the reservoir thus exposing the reservoir. Conversely, in its closed position, the lid overlies and covers the open top of the housing and simultaneously forms a slot between the lid and housing at opposed ends of the housing.

An elongated wiper is secured to the lid and this wiper is dimensioned so that, when the lid is moved to its closed position, the wiper extends into the reservoir. This wiper, furthermore, is substantially parallel to the slots at the opposed ends of the housing.

An infeed guide bar is secured to the housing between the wiper and one of the opposed ends of the housing while, similarly, an outfeed guide bar is secured to the housing between the wiper and the other of the opposed ends of the housing. These guide bars are substantially parallel to the wiper.

Each guide bar, furthermore, includes a plurality of longitudinally spaced ridges. These ridges serve to separate different bundles of fibers from each other so that a plurality of fiber bundles can be processed simultaneously with each fiber bundle being separated from its adjacent fiber bundle.

In practice, with the lid removed, a plurality of fiber bundles are positioned across the opposed ends of the housing so that the fiber bundles extend across the guide bars and with each fiber bundle positioned in between two spaced ridges on the guide bars. The lid is then positioned over the top of the housing so that the fiber bundles extend out through the slots formed on the opposed ends of the housing. Simultaneously, however, the wiper secured to the lid submerses a midportion of the fiber bundles into the reservoir which, in turn, is filled with a thermoplastic material. Thus, as the fiber bundles are drawn from one end of the housing and to the other end of the housing, the fiber bundles submerge into and pass through the reservoir and thus into the thermoplastic material. The guide bars and wiper, furthermore, serve to spread the fibers in each fiber bundle across the guide bars while the wiper forces the thermoplastic material into the fibers and ensures each fiber in each bundle is coated with the thermoplastic material.

After the fiber bundles are drawn through the housing, the thermoplastic material cools and hardens and the resulting coated fibers are then chopped into lengths for subsequent use in a molding operation.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
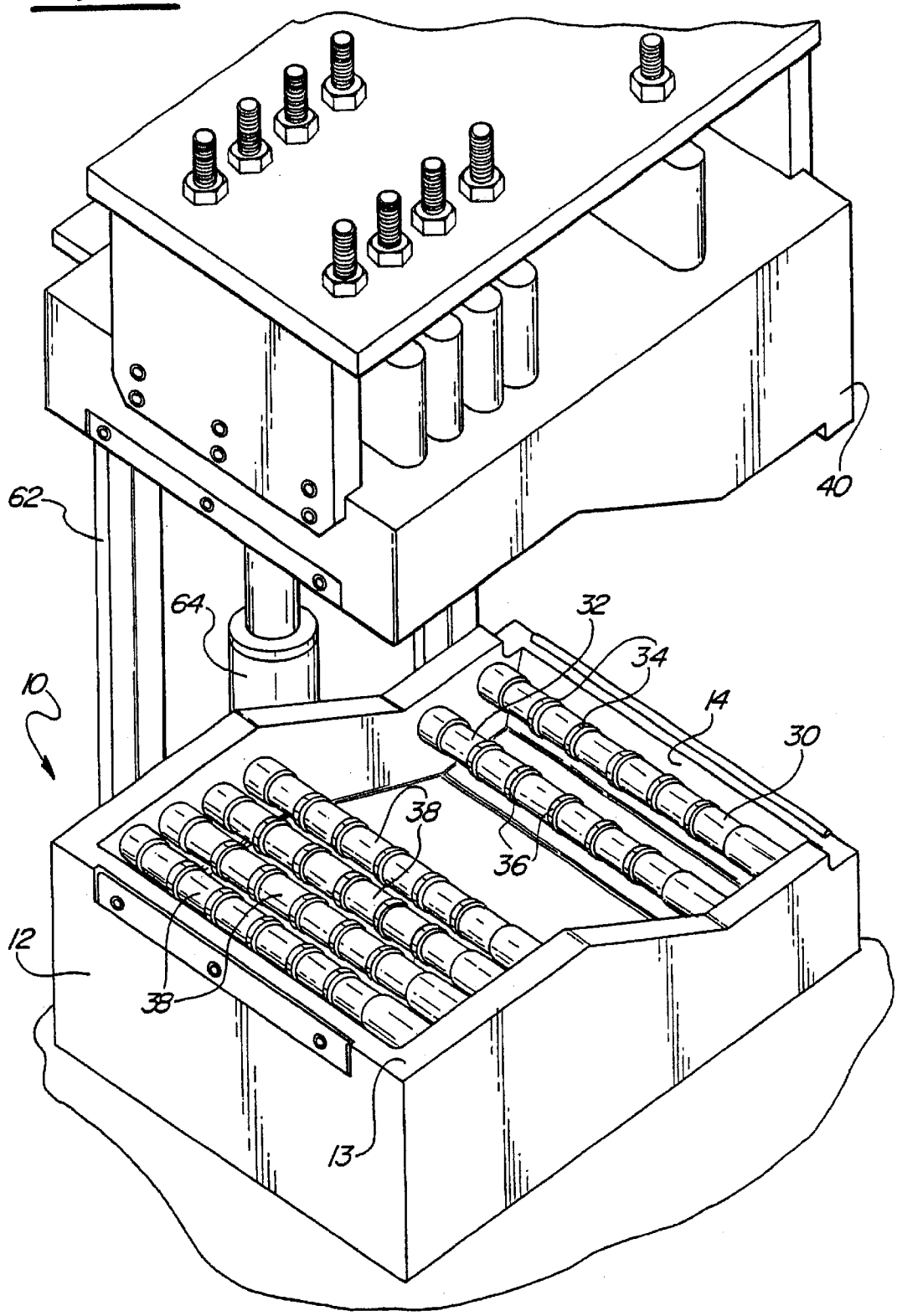
FIG. 1 is an elevational view illustrating a preferred embodiment of the present invention.
Figure 2:
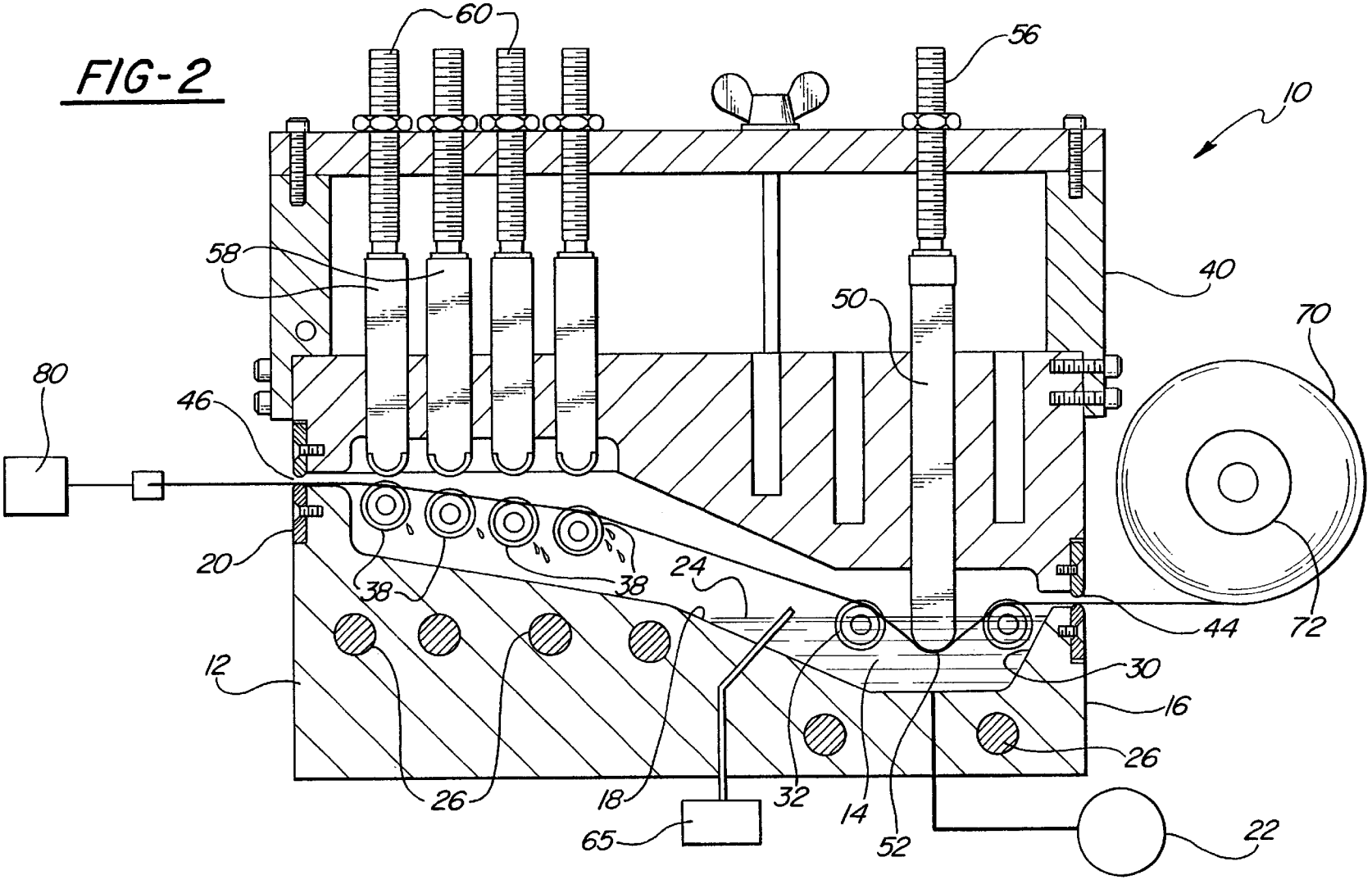
FIG. 2 is a side sectional view illustrating the preferred embodiment of the present invention.

With reference first to FIGS. 1 and 2, a preferred embodiment of the apparatus 10 for coating fibers is there shown and comprises a generally rectangular housing 12. The housing 12 defines a reservoir 14 closely adjacent one end 16 of the housing while a bottom wall 18 of the housing 12 slopes upwardly from the reservoir 14 toward the other end 20 of the housing 12 for a reason to be subsequently described.

With reference now particularly to FIG. 2, the reservoir 14 is adapted to be filled with a thermoplastic material, such as polypropylene, and any conventional means 22 is employed to maintain a preset level 24 in the reservoir 14. Electrical heating elements 26 are also provided in the housing 12 both around the reservoir 14 as well as under the upwardly slanting bottom wall 18 of the housing 12 in order to maintain the thermoplastic material in a molten state.

With reference again to FIGS. 1 and 2, an infeed guide bar 30 is secured to the housing 12 adjacent its end 16 so that the guide bar 30 extends generally parallel to the housing end 16. Similarly, an outfeed guide bar 32 is also secured to the housing 12 so that the outfeed guide bar 32 is generally parallel to the infeed guide bar 30, but spaced from the infeed guide bar 30 toward the housing end 20.

Each guide bar 30 and 32 is elongated and includes a plurality of longitudinally spaced raised ridges 34 and 36 (FIG. 1), respectively, along its length so that the ridges 34 on the infeed guide bar register with the ridges 36 on the outfeed guide bar 32. Furthermore, the spacing between adjacent ridges 34 and 36 on the infeed guide bar 30 and outfeed guide bar 32, respectively, are dimensioned to accommodate one fiber bundle, as will subsequently become apparent.

Referring now to FIGS. 1 and 2, at least one, and preferably up to four, outfeed guide rollers 38 are secured to the housing so that one guide roller 38 is positioned closely adjacent the end 20 of the housing 12. The guide roller 38 optionally contains raised ridges but, alternatively, may be continuous and curved along its upper side.

Referring now particularly to FIGS. 1 and 2, the apparatus 10 of the present invention further comprises a lid 40 which is movable between an open position (FIG. 1) and a closed position (FIG. 2). In its open position, the lid 40 exposes the open top 13 of the housing and thus is open to both the reservoir 14 as well as the bottom wall 18. Conversely, in its closed position (FIG. 2) the lid overlies and covers the open top 13 of the housing 12. However, when the lid 40 is in its closed position, an elongated inlet slot 44 (FIG. 2) is formed between the lid 40 and housing 12 at the housing end 16 while, similarly, an outlet slot 46 is formed between the housing 12 and lid 40 at the opposite end 20 of the housing 12.

As shown in FIG. 2, an elongated wiper 50 is secured to the lid 40 so that, when the lid 40 is moved to its closed position, the wiper 50 has a lower end 52 extending below the liquid level 24 of the reservoir 14 and in between and substantially parallel to the guide bars 30 and 32. The wiper 50 may be fixedly secured to the housing 40 or, as shown, adjustably secured by a threaded fastener 56.

Similarly, an elongated wiper 58 is also secured to the lid 40 for each outfeed roller 38 such that one wiper 58 registers with each outfeed guide bar 38. Like the wiper 50, the wipers 58 can be either fixedly secured to the lid 40 or, as illustrated in the drawing, adjustably secured by a threaded fastener 60.

Any conventional means can be employed to move the lid 40 between its open and closed position. However, in the preferred embodiment of the invention, the lid 40 is movably mounted on tracks 62 (FIG. 1) and movable by an actuator 64 between an open and a closed position.

In operation, in order to coat fibers, the lid is first moved to its open position. A plurality of fiber spools 70 (only one illustrated) are than mounted adjacent the housing end 16 and one fiber bundle is positioned across the housing 12 so that one fiber bundle is positioned between each pair of adjacent raised ridges 34 and 36 on the guide bars 30 and 32, respectively, and so that each fiber bundle extends from the housing end 16 into the housing end 20. Although the apparatus shown in the drawing accommodates six fiber bundles, more or fewer fiber bundles can be accommodated without deviation from the spirit or scope of the invention.

After the fiber bundles 72 have been positioned across the housing 12, the lid is moved to its closed position. In doing so, the wiper 50 engages the fiber bundles 72 thus forcing a portion of the fiber bundle around the wiper 50 beneath the reservoir level 24. The reservoir 24, in turn, is filled with a molten thermoplastic material from the source 22 and maintained in its molten state by the heaters 26. Furthermore, with the lid 40 in its closed position, the fiber bundles 72 are positioned through the slots 44 and 46 at the opposed ends 16 and 20 of the housing 12.

Any conventional means 80 (FIG. 2) can be used to engage the fiber bundles 72 as the fiber bundles 72 exit from the slot 46 and thus draw the fiber bundles 72 through the housing from the slot 44 and to the slot 46. In doing so, the fiber bundles 72 are forced into the molten thermoplastic material contained within the reservoir 14 such that the wiper 50, as well as the wipers 58 and guide bars 32 and 38, force or wipe the thermoplastic material around each fiber in each bundle 72.

In practice, it is desirable that the fibers in each bundle are spread apart as the fibers pass through the reservoir 14. Consequently, a conventional clutch mechanism not shown is preferably associated with each spool 70 in order to impart longitudinal tension on each fiber bundle 72. This tension, in turn, effectively spreads the fibers in each fiber bundle across the guide bars 30 and 32 and between the adjacent ridges 34 and 36, respectively, thus further ensuring that all of the fibers in each bundle 72 are coated with the thermoplastic material.

As the fiber bundles 72 are drawn through the apparatus 10 of the present invention, the wipers 58 with their associated guide bars 38 effectively remove any excess thermoplastic material from the fiber bundles 72. This excess material falls to the inclined bottom wall 18 of the housing 12. Since this bottom wall 18 is heated by the heaters 26, the excess material flows down the bottom wall 18 of the housing 12 and is returned to the reservoir 14. Furthermore, the adjustment means 60 on the wipers 58 provides a simple means for ensuring that excess thermoplastic material is removed from the fiber bundles 72 and returned to the reservoir 14.

It is known that preheating the fibers prior to their submersion in the reservoir 14 enhances complete coating of the fibers with the thermoplastic material. Additionally, the coated fiber bundles 72, after exiting from the housing slot 46, cure and are then chopped into smaller pieces for use as raw material in a molding operation.

The apparatus optionally includes means 65 (FIG. 2) for pressurizing the reservoir 14.

From the foregoing, it can be seen that the present invention provides a simple and yet totally effective apparatus for coating a plurality of fiber bundles with thermoplastic material. Having described my invention, however, many modifications thereto will become apparent to those skilled in the art to which it pertains without deviation from the spirit of the invention as defined by the scope of the appended claims.

I claim:

1. Apparatus for coating fibers with a thermoplastic material comprising:

a housing defining a reservoir, said housing having an open top open to said reservoir, a lid selectively movable between an open and a closed position, wherein in said open position said lid exposes said reservoir and in said closed position, said lid overlies said open top of said housing and forms a slot between said lid and said housing at opposed ends of said housing, an elongated wiper secured to said lid, said wiper extending into said reservoir when said lid is in said closed position and said wiper extending in a direction substantially parallel to said ends of said housing, at least one infeed guide bar secured to said housing between said wiper and one of said opposed ends of said housing, and at least one outfeed guide bar secured to said housing between said wiper and the other of said opposed ends of said housing.

2. The invention as defined in claim 1 wherein each guide bar includes a plurality of longitudinally spaced ridges.

3. The invention as defined in claim 1 and including an outfeed wiper secured to said lid, said output wiper registering with and closely adjacent said outfeed guide bar when said lid is in said closed position.

4. The invention as defined in claim 3 and comprising means for adjusting the spacing between said outfeed guide bar and said outfeed wiper.

5. The invention as defined in claim 4 wherein said adjusting means comprises a threaded fastener for mounting said outfeed wiper to said lid.

6. The invention as defined in claim 1 and comprising means in said housing for heating said reservoir.

7. The invention as defined in claim 1 and comprising means for pressurizing said reservoir.

8. The invention as defined in claim 1 and comprising motor means for moving said lid between said open and said closed position.

9. The invention as defined in claim 1 wherein in said open position said lid is spaced both vertically and laterally from said open top of said housing.

10. The invention as defined in claim 1 and comprising a plurality of spaced apart and parallel outfeed guide bars secured to said housing.

* * * * *